US009249679B2

(12) United States Patent
Berkebile et al.

(10) Patent No.: US 9,249,679 B2
(45) Date of Patent: Feb. 2, 2016

(54) IMPINGEMENT SLEEVE AND METHODS FOR DESIGNING AND FORMING IMPINGEMENT SLEEVE

(75) Inventors: Matthew Paul Berkebile, Mauldin, SC (US); Jerome David Brown, Simpsonville, SC (US); Ronald James Chila, Greenfield Center, NY (US); Patrick Benedict Melton, Horse Shoe, NC (US); Russell DeForest, Simpsonville, SC (US); David William Cihlar, Greenville, SC (US); Wei Chen, Greer, SC (US); John Drake Vanselow, Taylors, SC (US)

(73) Assignee: General Electric Company, Schenectady, NY (US)

( * ) Notice: Subject to any disclaimer, the term of this patent is extended or adjusted under 35 U.S.C. 154(b) by 722 days.

(21) Appl. No.: 13/589,375

(22) Filed: Aug. 20, 2012

(65) Prior Publication Data

US 2012/0304659 A1 Dec. 6, 2012

Related U.S. Application Data

(63) Continuation-in-part of application No. 13/048,394, filed on Mar. 15, 2011, now Pat. No. 8,887,508.

(51) Int. Cl.
*F23R 3/06* (2006.01)
*F01D 9/02* (2006.01)

(52) U.S. Cl.
CPC . *F01D 9/023* (2013.01); *F23R 3/06* (2013.01); *F05D 2260/201* (2013.01); *F23R 2900/03044* (2013.01)

(58) Field of Classification Search
CPC .. F23R 3/002; F23R 3/06; F23R 2900/03044; F23R 2900/03041; F23R 2900/03042; F01D 9/023
USPC ..... 60/752–760; 703/8
See application file for complete search history.

(56) References Cited

U.S. PATENT DOCUMENTS

| | | | | |
|---|---|---|---|---|
| 3,981,142 | A * | 9/1976 | Irwin | 60/753 |
| 4,719,748 | A | 1/1988 | Davis, Jr. et al. | |
| 4,805,397 | A * | 2/1989 | Barbier et al. | 60/800 |
| 4,887,432 | A * | 12/1989 | Mumford et al. | 60/759 |
| 4,916,906 | A * | 4/1990 | Vogt | 60/757 |
| 4,984,429 | A | 1/1991 | Waslo et al. | |
| 6,000,908 | A * | 12/1999 | Bunker | 416/95 |
| 6,568,187 | B1 | 5/2003 | Jorgensen et al. | |
| 6,640,547 | B2 | 11/2003 | Leahy, Jr. | |
| 7,082,766 | B1 | 8/2006 | Widener et al. | |
| 7,493,767 | B2 | 2/2009 | Bunker et al. | |
| 7,617,684 | B2 | 11/2009 | Norster | |
| 7,707,835 | B2 | 5/2010 | Lipinski et al. | |

(Continued)

*Primary Examiner* — Steven Sutherland
(74) *Attorney, Agent, or Firm* — Dority & Manning, P.A.

(57) ABSTRACT

An impingement sleeve and methods for designing and forming an impingement sleeve are disclosed. In one embodiment, the impingement sleeve includes a body configured to at least partially surround a transition piece of the combustor. The impingement sleeve further includes a plurality of cooling holes defined in the body, the plurality of cooling holes having a cooling hole pattern configured to provide a desired operational value for the transition piece. At least one of the plurality of cooling holes has a chamfer extending at least partially between an inlet and an outlet of the at least one of the plurality of cooling holes. At least a portion of the plurality of cooling holes are generally longitudinally asymmetric.

20 Claims, 5 Drawing Sheets

(56) References Cited

U.S. PATENT DOCUMENTS

2008/0276619 A1* 11/2008 Chopra et al. ..... 60/760
2009/0235668 A1* 9/2009 Johnson et al. ..... 60/782
2009/0249791 A1* 10/2009 Belsom ..... 60/755
2009/0252593 A1 10/2009 Chila et al.
2010/0037620 A1 2/2010 Chila
2010/0077761 A1 4/2010 Johnson et al.

* cited by examiner

FIG. —1—

IMPINGEMENT SLEEVE AND METHODS FOR DESIGNING AND FORMING IMPINGEMENT SLEEVE

RELATED APPLICATIONS

The present application is a Continuation-in-Part Application of U.S. patent application Ser. No. 13/048,394, filed on Mar. 15, 2011.

FIELD OF THE INVENTION

The present disclosure relates in general to combustors, and more particularly to impingement sleeves for combustors and methods for designing and forming the impingement sleeves.

BACKGROUND OF THE INVENTION

Turbine systems are widely utilized in fields such as power generation. For example, a conventional gas turbine system includes a compressor, a combustor, and a turbine. During operation of the turbine system, various components in the system may be subjected to high temperature flows, which can cause the components to fail. Since higher temperature flows generally result in increased performance, efficiency, and power output of the gas turbine system, the components that are subjected to high temperature flows must be cooled to allow the gas turbine system to operate at increased temperatures.

One such component that requires cooling during operation is the transition piece in the combustor. The transition piece is generally connected to the combustor liner, and provides a transition passage for hot gas flowing from the combustor liner to the turbine. Thus, the transition piece is exposed to high temperatures from the hot gas flowing therethrough, and generally requires cooling.

A typical combustor utilizes an impingement sleeve surrounding the transition piece and creating a flow path therebetween to cool the transition piece. Rows of similarly sized holes are defined in the impingement sleeve, and cooling air or other working fluids are flowed through the holes into the flow path. The working fluid flowing through the flow path may cool the transition piece.

As stated, typical impingement sleeves utilize rows of similarly sized holes for flowing working fluid therethrough. Each generally peripheral row has a plurality of identically sized, generally longitudinally symmetrical, holes. The size of the holes for a row generally decreases in the direction of the turbine. In many cases, this arrangement of cooling holes does not provide optimal cooling of the transition piece. For example, many transition pieces may include surface area portions that are particularly susceptible to excessive thermal loads. However, typical arrangements of cooling holes do not target these portions. Thus, cooling of these portions may be inadequate. Additionally, the current arrangement of cooling holes generally causes relatively large pressure drops, which may be disadvantageous for operation of the combustor and system in general.

Thus, improved impingement sleeves and methods for designing and forming impingement sleeves would be desired in the art. For example, impingement sleeves and methods that provided optimal, targeted cooling of transition pieces would be advantageous. Further, impingement sleeves and methods that reduced associated pressure drops would be advantageous.

BRIEF DESCRIPTION OF THE INVENTION

Aspects and advantages of the invention will be set forth in part in the following description, or may be obvious from the description, or may be learned through practice of the invention.

In one embodiment, a method for designing an impingement sleeve is disclosed. The method includes determining a desired operational value for a transition piece, inputting a combustor characteristic into a processor, and utilizing the combustor characteristic in the processor to determine a cooling hole pattern for the impingement sleeve, the cooling hole pattern comprising a plurality of cooling holes, at least a portion of the plurality of cooling holes being generally longitudinally asymmetric, the cooling hole pattern providing the desired operational value.

In another embodiment, a method for forming an impingement sleeve is disclosed. The method includes designing a cooling hole pattern for the impingement sleeve, the cooling hole pattern including a plurality of cooling holes, at least a portion of the plurality of cooling holes being generally longitudinally asymmetric, the cooling hole pattern configured to provide a desired operational value for a transition piece. The method further includes manufacturing an impingement sleeve, the impingement sleeve defining a plurality of cooling holes having the cooling hole pattern.

In another embodiment, an impingement sleeve for a combustor is disclosed. The impingement sleeve includes a body configured to at least partially surround a transition piece of the combustor. The impingement sleeve further includes a plurality of cooling holes defined in the body, the plurality of cooling holes having a cooling hole pattern configured to provide a desired operational value for the transition piece. At least a portion of the plurality of cooling holes are generally longitudinally asymmetric.

In another embodiment, an impingement sleeve for a combustor is disclosed. The impingement sleeve includes a body configured to at least partially surround a transition piece of the combustor. The impingement sleeve further includes a plurality of cooling holes defined in the body, the plurality of cooling holes having a cooling hole pattern configured to provide a desired operational value for the transition piece. At least one of the plurality of cooling holes has a chamfer extending at least partially between an inlet and an outlet of the at least one of the plurality of cooling holes. At least a portion of the plurality of cooling holes are generally longitudinally asymmetric.

In another embodiment, an impingement sleeve for a combustor is disclosed. The impingement sleeve includes a body configured to at least partially surround a transition piece of the combustor. The impingement sleeve further includes a plurality of cooling holes defined in the body, the plurality of cooling holes having a cooling hole pattern configured to provide a desired operational value for the transition piece. At least a portion of the plurality of cooling holes are generally longitudinally asymmetric. The impingement sleeve further includes an insert extending through one of the plurality of cooling holes. The insert defines an insert cooling hole.

In another embodiment, a method for designing an impingement sleeve is disclosed. The method includes determining a desired operational value for a transition piece, inputting a combustor characteristic into a processor, and utilizing the combustor characteristic in the processor to determine a cooling hole pattern for the impingement sleeve, the cooling hole pattern including a plurality of cooling holes, at least a portion of the plurality of cooling holes being generally longitudinally asymmetric, the cooling hole pattern providing the desired operational value. In some embodiments, at least one of the plurality of cooling holes has a chamfer extending at least partially between an inlet and an outlet of the at least one of the plurality of cooling holes. In other embodiments, an insert extends through one of the plurality of cooling holes. The insert defines an insert cooling hole.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
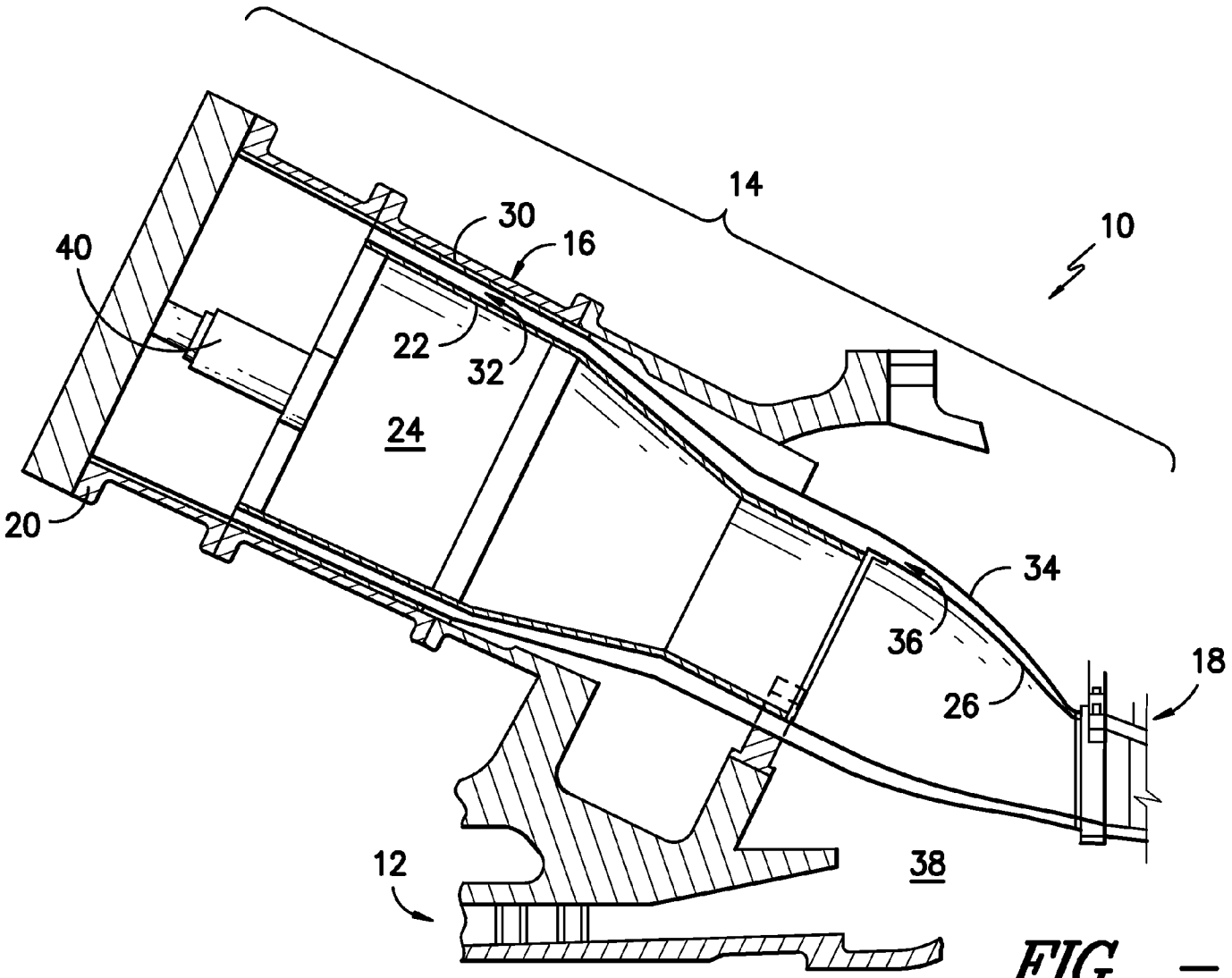
FIG. 1 is a cross-sectional view of several portions of a gas turbine system according to one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring to FIG. 1, a simplified drawing of several portions of a gas turbine system 10 is illustrated. The system 10 comprises a compressor section 12 for pressurizing a working fluid, discussed below, that is flowing through the system 10. Pressurized working fluid discharged from the compressor section 12 flows into a combustor section 14, which is generally characterized by a plurality of combustors 16 (only one of which is illustrated in FIG. 1) disposed in an annular array about an axis of the system 10. The working fluid entering the combustor section 14 is mixed with fuel, such as natural gas or another suitable liquid or gas, and combusted. Hot gases of combustion flow from each combustor 16 to a turbine section 18 to drive the system 10 and generate power.

Each combustor 16 in the gas turbine 10 may include a variety of components for mixing and combusting the working fluid and fuel. For example, the combustor 16 may include a casing 20, such as a compressor discharge casing 20. A variety of sleeves, which may be generally annular sleeves, may be at least partially disposed in the casing 20. For example, a combustor liner 22 may generally define a combustion zone 24 therein. Combustion of the working fluid, fuel, and optional oxidizer may generally occur in the combustion zone 24. The resulting hot gases of combustion may flow downstream through the combustion liner 22 into a transition piece 26. A flow sleeve 30 may generally surround at least a portion of the combustor liner 22 and define a flow path 32 therebetween. An impingement sleeve 34 may generally surround at least a portion of the transition piece 26 and define a flow path 36 therebetween. Working fluid entering the combustor section 14 may flow in the casing 20 through an external annulus 38 defined by the casing 20 and at least partially surrounding the various sleeves. At least a portion of the working fluid may enter the flow paths 32 and 36 through holes (not shown) defined in the flow sleeve and 30 and impingement sleeve 34. As discussed below, the working fluid may then enter the combustion zone 24 for combustion.

The combustor 16 may further include a fuel nozzle 40 or a plurality of fuel nozzles 40. Fuel may be supplied to the fuel nozzles 40 by one or more manifolds (not shown). As discussed below, the fuel nozzle 40 or fuel nozzles 40 may supply the fuel and, optionally, working fluid to the combustion zone 24 for combustion.

It should be readily appreciated that a combustor 16 need not be configured as described above and illustrated herein and may generally have any configuration that permits working fluid to be mixed with fuel, combusted and transferred to a turbine section 18 of the system 10. For example, the present disclosure encompasses annular combustors and silo-type combustors as well as any other suitable combustors.

Figure 2:
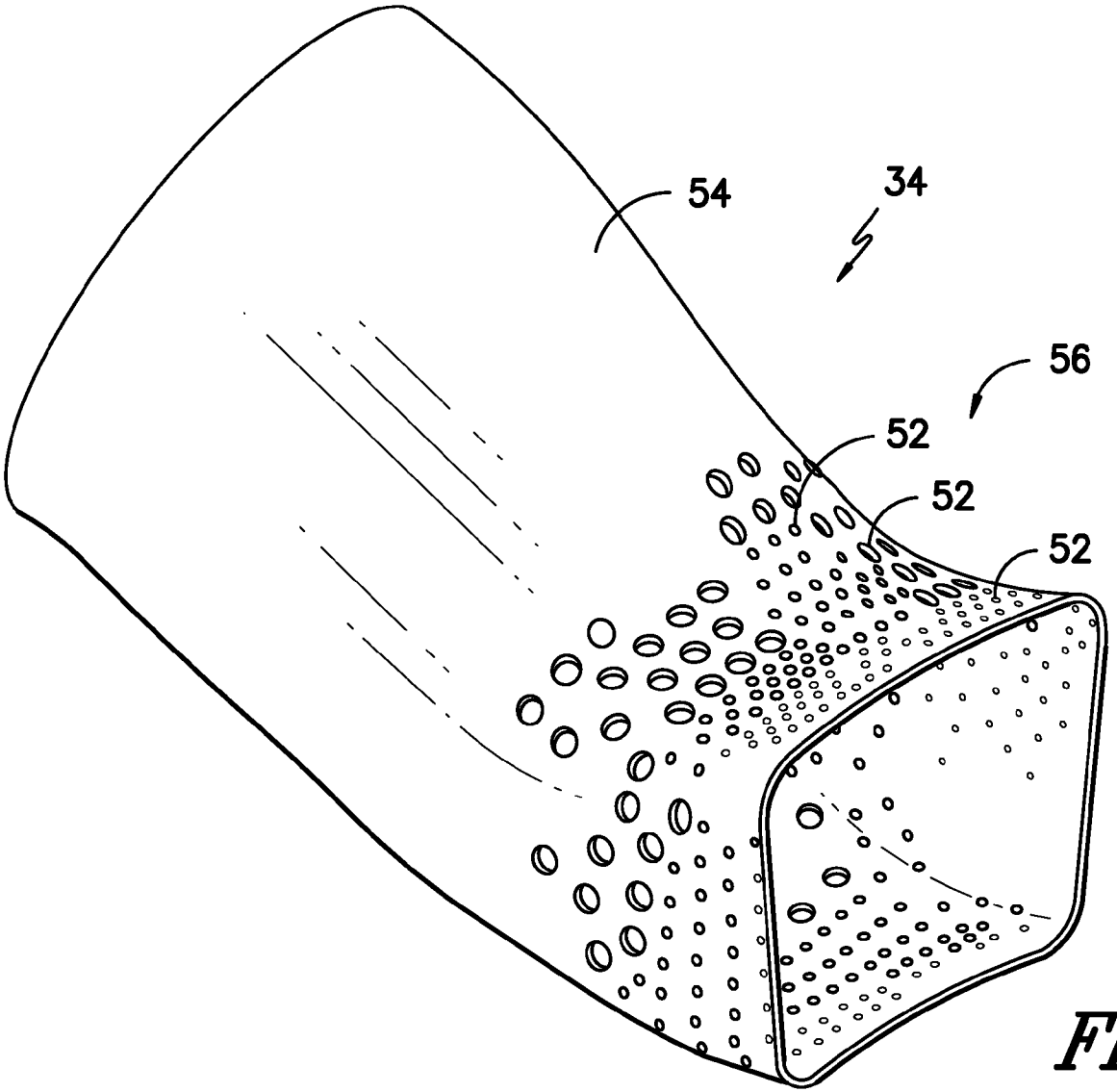
FIG. 2 is a perspective view of an impingement sleeve according to one embodiment of the present disclosure.

FIG. 2 illustrates an impingement sleeve 34 according to one embodiment of the present disclosure. As shown, the impingement sleeve 34 may define a plurality of cooling holes 52. As discussed above, the cooling holes 52 may allow working fluid to flow therethrough into flow path 36, such that the working fluid may cool the transition piece 26. In general, the working fluid cools the transition piece 26 through two types of cooling—local impingement flow, wherein the working fluid travels through a cooling hole 52 and directly impacts a localized surface of the transition piece 26, and regional crossflow, wherein the working fluid travels generally through the flow path 36 proximate or adjacent to a region of the transition piece 26 surface.

In many cases, it may be desirable for the cooling of the transition piece 26 to provide one or more desired operation values for the transition piece 26, such as a generally uniform or average value. In general, an operational value is a condition of the transition piece 26 or a portion thereof that, during operation of the system 10, can be affected by cooling of the transition piece 26. Thus, a desired operational value is a desired value, whether uniform, average, or otherwise, for that characteristic. For example, in some exemplary embodiments, a desired operational value may be a generally uniform and/or average low cycle fatigue value, a generally uniform and/or average temperature, such as outer or inner surface temperature, a generally uniform and/or average strain, a generally uniform and/or average cooling value, and/or a generally uniform and/or average thermal barrier coating temperature, or at least one of the above. It should be understood, however, that the present disclosure is not limited to the above disclosed desired operational values, and rather that any suitable desired operational values, whether generally uniform, average, or otherwise, are within the scope and spirit of the present disclosure.

Thus, the impingement sleeve 34 of the present disclosure may include a body 54 configured to at least partially surround a transition piece 26, as discussed above. Further, the impingement sleeve 34 may include a plurality of cooling holes 52 defined in the body 54. Advantageously, the cooling holes 52 may have a cooling hole pattern 56 configured to provide a desired operational value or a plurality of desired operational values for the transition piece 26 that the impingement sleeve 34 at least partially surrounds. Further, the cooling hole pattern 56 may be configured to improve the desired operational value or values. In general, at least a portion, or all, of the cooling holes 52 in the cooling hole pattern 56 may be generally longitudinally asymmetric. The longitudinal direction may generally be defined as the direction of flow of hot gas through the transition piece 26. Thus, at least a portion, or all, of the cooling holes may be generally asymmetric about a line drawn in the longitudinal direction. The asymmetry may result from, for example, the size of the cooling holes 52, the shape of the cooling holes 52, the spacing between the cooling holes 52, the number of cooling holes 52, or any other suitable asymmetric feature of the various cooling holes 52 of the cooling hole pattern 56. The cooling hole pattern 56 may thus be modeled to provide the desired operational value or plurality of desired operational values.

Figure 3:
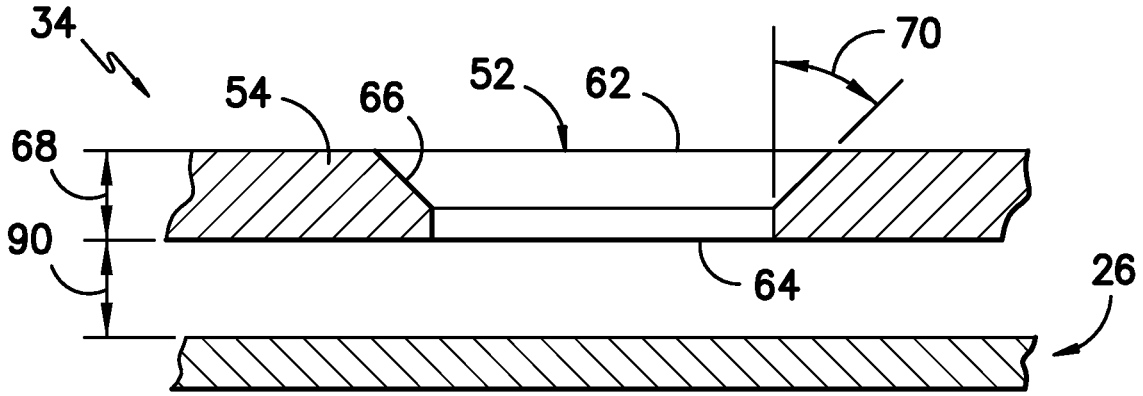
FIG. 3 is a cross-sectional view of an impingement sleeve cooling hole according to one embodiment of the present disclosure.
Figure 4:
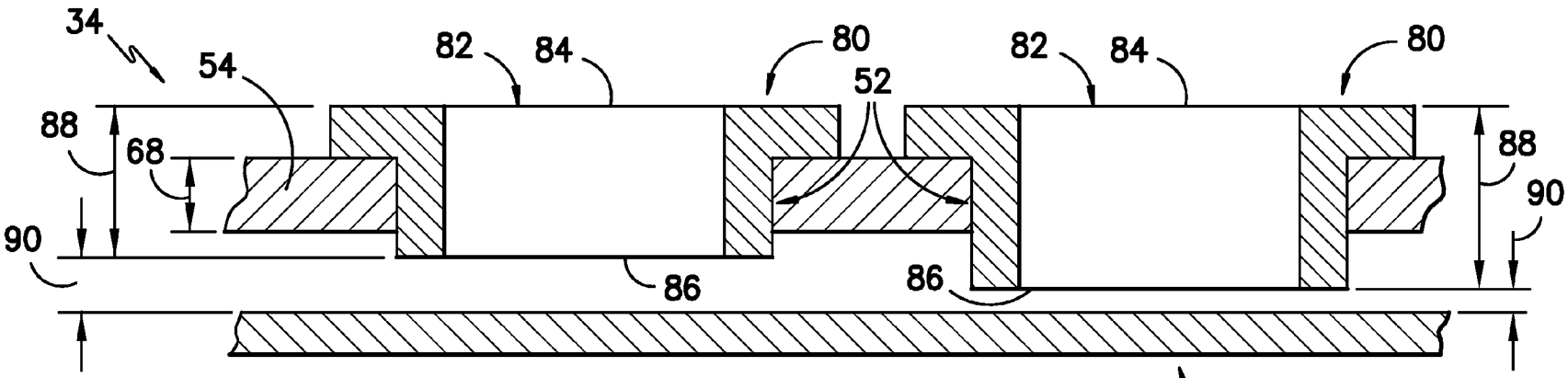
FIG. 4 is a cross-sectional view of impingement sleeve cooling holes according to another embodiment of the present disclosure.
Figure 5:
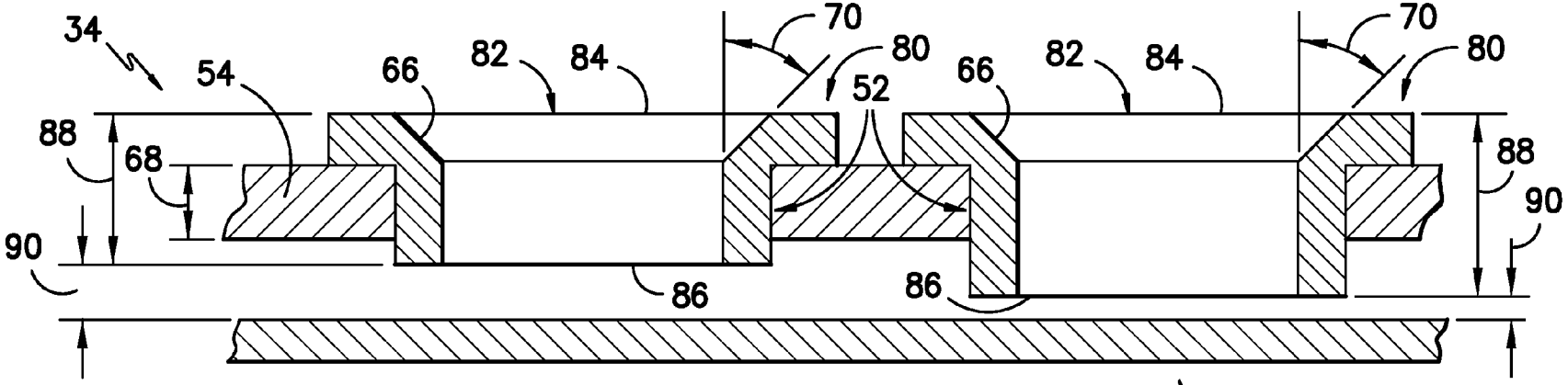
FIG. 5 is a cross-sectional view of impingement sleeve cooling holes according to another embodiment of the present disclosure.

Further, in some embodiments, various cooling holes 52 may have various characteristics intended to increase the cooling provided by those individual cooling holes 52. FIGS. 3 through 5 illustrate various embodiments of cooling holes 52 having such characteristics. As shown in FIGS. 3 and 5, for example, in some embodiments one or more cooling holes 52 may have a chamfer. As shown, a chamfer is generally a taper in the size of a cooling hole 52 that occurs between an inlet 62 and an outlet 64 of a cooling hole 52. A chamfered inner surface 66 is thus formed in a cooling hole 52 by the chamfer. The chamfered inner surface 66 may have a generally linear cross-sectional profile, as shown, or a generally curvilinear cross-sectional profile. Further, a chamfered inner surface 66 in exemplary embodiments extends generally evenly about an entire periphery of a cooling hole 52.

As shown, a chamfer extends at least partially between the inlet 62 and the outlet 64 of a cooling hole 52. In some embodiments as shown in FIGS. 3 and 5, the chamfer extends from the inlet 62 towards the outlet 64. In other embodiments, the chamfer may extend from a suitable location within the cooling hole to the outlet 64, rather than beginning at the inlet 62. In other embodiments, the chamfer may begin and end within the cooling hole 52 between the inlet 62 and outlet 64. In still other embodiments, the chamfer may extend from the inlet 62 to the outlet 64, and thus in these embodiments be a bevel. Further, a distance, or thickness 68, may be defined between an inlet 62 and an outlet 64 of a cooling hole 52, as shown. As discussed, a chamfer may thus extend through the thickness 68 of a cooling hole 52 or any suitable portion thereof. In some embodiments, a chamfer extends between approximately 5% and approximately 90% of the thickness 68. In other embodiments, a chamfer extends between approximately 5% and approximately 80%, approximately 10% and approximately 80%, approximately 20% and approximately 80%, approximately 30% and approximately 80%, or approximately 50% and approximately 80% of the thickness 68.

A chamfer may further be at any suitable angle 70. In some embodiments, for example, the chamfer may be at an angle 70 between approximately 10 degrees and approximately 60 degrees, approximately 20 degrees and approximately 50 degrees, or approximately 20 degrees and approximately 40 degrees. In some embodiments, for example, a chamfer may be at approximately 30 degrees.

It should be understood that the present disclosure is not limited to the above disclosed ranges, and rather that any suitable portion of the thickness 68 or angle 70, or any range or subrange thereof, is within the scope and spirit of the present disclosure.

In other embodiments, an impingement sleeve 34 according to the present disclosure may include one or more inserts 80, as shown in FIGS. 4 and 5. Each insert 80 may be disposed in a cooling hole 52 such that the insert 80 extends through the cooling hole 52. As shown, an insert 80 according to the present disclosure includes an insert cooling hole 82 defined therein and extending between an inlet 84 and an outlet 86. Use of an insert 80 disposed in a cooling hole 52 may advantageously reduce the area of the cooling hole 52 at any point along the thickness of the cooling hole 68, by requiring the working fluid to flow through the generally smaller insert cooling hole 52.

In some embodiments, as shown in FIG. 5, the chamfer provided in a cooling hole 52 is provided in the insert 80 extending through the cooling hole 52. Thus, the insert cooling hole 82 may have the chamfer, and include the chamfer surface 66, and thus form a cooling hole 52 having a chamfer. The chamfer provided on the insert cooling hole 82 may extend through any suitable portion of a thickness 88 of the insert cooling hole 82 which extends between the inlet 84 and outlet 86 thereof, and may extend at any suitable angle 70 and have any other suitable characteristics as discussed above.

In some embodiments, as shown in FIGS. 4 and 5, the thickness 88 of the insert cooling hole 82 may be greater than the thickness 68 of the cooling hole 52. For example, the inlet 84 of the insert 80 may protrude from the inlet 62 and/or the outlet 86 may protrude from the outlet 64. Protrusion of the outlet 86 may, for example, advantageously decrease the distance 90 between the outlet 86 and the transition piece 26.

The inclusion of a chamfer on one or more cooling holes 52 according to the present disclosure is particularly advantageous, because chamfering of the cooling holes 52 may provide improved working fluid flow characteristics. For example, chamfering of a cooling hole 52 decreases the size of the outlet 64 of the cooling hole 52 relative to the inlet 62 of that cooling hole 52. Thus, working fluid flowing through the cooling hole 52 may increase in velocity between the inlet 62 and outlet 64. Further, chamfering may reduce pressure drops for the working fluid flowing through the cooling holes 52. Cooling efficiency for the cooling holes 52 and impingement sleeve 34 in general is thus increased.

The inclusion of an insert 80 in one or more cooling holes 52 according to the present disclosure is further particularly advantageous. For example, the insert 80 may in some embodiments provide the chamfer, which may provide advantageous characteristics as discussed above. Further, the insert 80 may in some embodiments decrease the distance 90 between the outlet 86 and the transition piece 26. Decreasing of this distance 90 may advantageously increase the cooling effects of local impingement flow through the cooling holes 52 with inserts 80 provided therein. Further, decreasing of the distance 90 may block a portion of the regional crossflow at the location of these cooling holes, which may advantageously reduce cross-flow degradation of the local impingement flow.

Further, in some embodiments, the thicknesses 88 and distances 90 may vary between cooling holes 52 and inserts 80. Such varying of thicknesses 88 and distances 90 may allow for further refinement of the various cooling effects throughout the impingement sleeve 34, such that an actual cooling profile for the impingement sleeve 34 can better approximate a designed cooling profile for the impingement sleeve 34. For example, cooling holes 52 that are upstream relative to other cooling holes 52 with respect to the direction of flow through the impingement sleeve 34 (from right to left in FIGS. 4 and 5) may have inserts 80 with relatively larger thicknesses 88 and relatively smaller distances 90 relative to the downstream cooling holes 52. Alternatively, however, the upstream cooling holes 52 may have smaller insert thicknesses 88 and larger distances 90, or the various cooling holes 52 may have any suitable insert thicknesses 88 and distances 90 relative to one another. As discussed above, the thickness 88 and distance 90 may affect local impingement flow and regional cross-flow. These resulting changes may further affect downstream cooling. Thus, for example, thicknesses 88 and distances 90 for downstream cooling holes 52 may be adjusted based on the resulting cooling effects on upstream cooling holes 52 from the associated thicknesses 88 and distances 90. These adjustments and variances in thickness 88 and distance 90 may be included during initial designing and forming of the impingement sleeves 34 and/or may be adjusted after initial designing and forming to ensure that the actual cooling profile for the final impingement sleeve 34 better approximates the designed cooling profile for the impingement sleeve 34.

It should additionally be understood that any insert 80 or cooling hole 52 characteristic, including for example chamfer angle 70 or chamfer extension distance within an insert 80 or cooling hole 52, may vary from cooling hole 52 to cooling hole 52. It should further be understood that these variations may be utilized as discussed above with respect to thickness 88 and distance 90 to ensure that the actual cooling profile for the final impingement sleeve 34 better approximates the designed cooling profile for the impingement sleeve 34.

Figure 6:
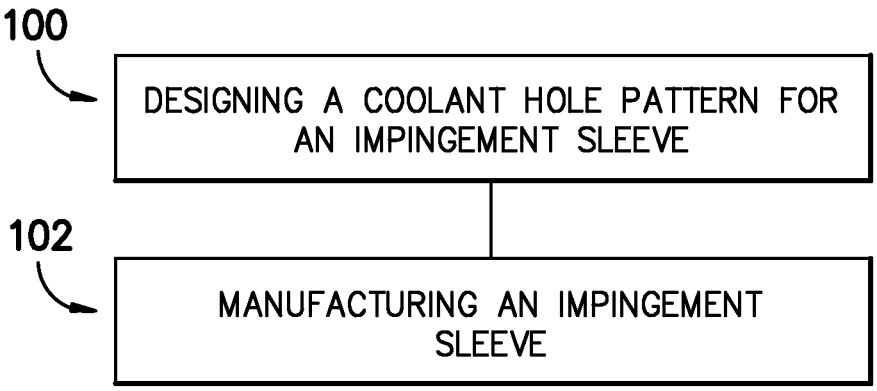
FIG. 6 is a flow chart illustrating a method for forming an impingement sleeve according to one embodiment of the present disclosure.
Figure 7:
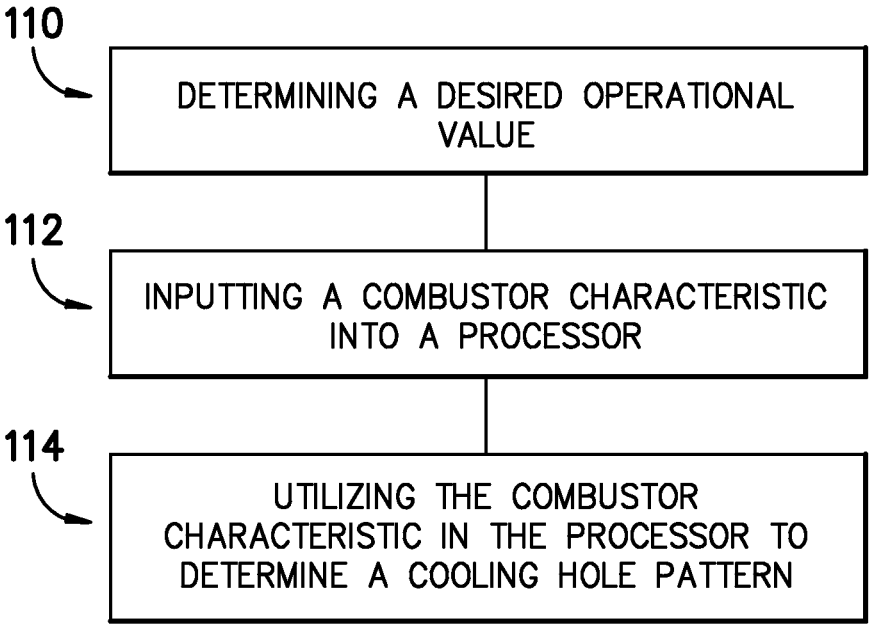
FIG. 7 is a flow chart illustrating a method for designing an impingement sleeve according to one embodiment of the present disclosure.

Thus, as shown in FIGS. 6 and 7, the present disclosure is further directed to novel methods for designing and forming impingements sleeves 34. The impingement sleeves 34 may comprise cooling hole patterns 56 configured to provide a desired operational value or a plurality of desired operational values for the transition piece 26 that the impingement sleeve 34 is designed to at least partially surround. FIG. 6 is a flow chart illustrating one embodiment of a method for forming an impingement sleeve 34, while FIG. 7 is a flow chart illustrating one embodiment of a method for designing an impingement sleeve 34. It should be understood that the steps as shown in FIGS. 6 and 7 and described herein need not be described in any specific order, but rather that any suitable order and/or combination of steps is within the scope and spirit of the present disclosure.

Thus, as shown in FIG. 6, the method for forming an impingement sleeve 34 according to the present disclosure may thus include, for example, designing a cooling hole pattern 56 for the impingement sleeve 34, as represented by reference numeral 100. The cooling hole pattern 56 may be configured to provide a desired operational value or values for a transition piece 26. The method may further include manufacturing the impingement sleeve 34, as represented by reference numeral 102. The impingement sleeve 34, after manufacturing, may define a plurality of cooling holes 52 having the cooling hole pattern 56. The manufacturing step 102 may comprise, for example, drop forging, casting, or any other suitable manufacturing process. The cooling holes 52 may be defined in the body 54 of the impingement sleeve 34 during, for example, drop forging or casting, or may be defined in the impingement sleeve 34 after the body 54 is, for example, drop forged or casted. For example, in some embodiments, the cooling holes 52 may be drilled into or otherwise defined in the body 54.

The designing step 100 may include a variety of steps that may be included in the method for designing an impingement sleeve 34, as shown in FIG. 7. For example, the designing step 100 may include the step of determining a desired operational value or a plurality of desired operational values for a transition piece 26, as discussed above and as represented by reference numeral 110. The determining step 100 may involve, for example, choosing a desired operation value or values for which the cooling hole pattern 56 will be designed.

Further, the designing step 100 may include, for example, inputting a combustor characteristic or a plurality of combustor characteristics into a processor, as represented by reference numeral 112. In general, a combustor characteristic is a feature of a combustor 16 or component thereof, such as a transition piece 26 or impingement sleeve 34, which, during operation of the system 10, may affect cooling of the transition piece 26. For example, a combustor characteristic may be hot gas temperature, working fluid temperature, transition piece 26 stress, transition piece 26 strain, transition piece 26 material, impingement sleeve 34 geometry, spacing between impingement sleeve 34 and transition piece 26, number of cooling holes 52, number of cooling hole 52 sizes, cooling hole 52 sizes, total area of cooling holes 52, chamfer angle 70 for those cooling holes 52 having a chamfer, chamfer thickness, cooling hole thickness 68, insert 80 thickness 88, or insert 90 relative thickness 88 with respect to other inserts 80, or at least one of the above.

In some embodiments, for example, a combustor characteristic may be the number of cooling hole 52 sizes. In exemplary embodiments, the number of cooling hole 52 sizes may be in the range between 2 and 10, although it should be understood that any suitable number or range of cooling hole 52 sizes is within the scope and spirit of the present disclosure. Additionally or alternatively, a combustor characteristic may be cooling hole 52 sizes. In exemplary embodiments, the sizes of various cooling holes 52 may be 0.0625 inches in diameter, 0.125 inches in diameter, 0.25 inches in diameter, 0.5 inches in diameter, 0.75 inches in diameter, or any other suitable size or range of sizes. For cooling holes 52 having a chamfer, the inlet 62 size and/or outlet 64 size may be included. For cooling holes 52 including an insert 80 extending therethrough, the cooling hole size may be that of the insert cooling hole 82.

It should be understood, however, that the present disclosure is not limited to the above disclosed combustor characteristics, and rather that any suitable combustor characteristics, whether generally of the transition piece 26, impingement sleeve 34, or otherwise, are within the scope and spirit of the present disclosure.

As stated above, the combustor characteristic or characteristics may be input into a processor. In exemplary embodiments, the processor may be a computer. The computer may generally include hardware and/or software that may allow for a cooling hole pattern 56 to be designed for an impingement sleeve 34 based on inputs, such as combustor characteristics, and suitable algorithms. It should be understood that the term "processor" is not limited to integrated circuits referred to in the art as a computer, but broadly refers to a controller, a microcontroller, a microcomputer, a programmable logic controller (PLC), an application specific integrated circuit, and other programmable circuits, and these terms are used interchangeably herein. It should be understood that a processor and/or a control system can also include memory, input channels, and/or output channels.

The designing step 100 may further include, for example, utilizing the combustor characteristic or plurality of combustor characteristics in the processor to determine the cooling hole pattern 56, as represented by reference numeral 114. For example, as discussed above, the processor may contain suitable hardware and/or software containing suitable algorithms for producing a cooling hole pattern 56 based on a variety of inputs. Thus, after the inputs, such as the combustor characteristic and other various inputs as discussed below, are input into the processor, the processor may output a cooling hole pattern 56 for an impingement sleeve 34 that is configured to provide a desired operational value or operational values for a transition piece 26, as discussed above.

The designing step 100 may further include, for example, determining a heat flux of the transition piece 26. Heat flux is the rate of heat transfer through a surface. Thus, the heat flux of the transition piece 26 may be determined for the entire surface of the transition piece 26 or any portion thereof. The heat flux may be determined experimentally or analytically using any suitable device and/or process. The heat flux, after being determined, may be input into the processor to further assist in the design of the cooling hole pattern 56.

The designing step 100 may further include, for example, determining a required cooling mode for a desired operational value or values. As discussed above, the cooling types utilized to cool the transition piece 26 may be localized impingement flow and regional crossflow. For various portions of the surface of the transition piece 26, it may be desirable for the cooling mode for that portion to include one or both of the cooling types in various quantities, in order to provide desirable cooling characteristics. Thus, these cooling types and various quantities or ranges of quantities of cooling flow for the cooling types may be determined for the entire surface of the transition piece 26 or any portion thereof. The cooling mode for a specified portion of the surface of the transition piece 26 may include one or both cooling types in various quantities or ranges of quantities, which may provide a balance of cooling types to provide optimal cooling of that surface portion. Further, in some embodiments, the cooling mode may be dependent on the heat flux. For example, the cooling mode for various portions of the surface of the transition piece 26 may be determined based on the size and number of higher temperature spots or regions on the portion, which may be determined by determining the heat flux. Smaller and/or hotter spots may be better cooled using a cooling mode including more impingement flow and less regional crossflow, while larger and/or less hot spots may be better cooled using a cooling mode including more regional crossflow and less impingement flow. The cooling mode, after being determined, may be input into the processor to further assist in the design of the cooling hole pattern 56.

The designing step may further include, for example, partitioning the transition piece 26 into a plurality of segments. Each segment may include a portion of the surface of the transition piece 26. For example, in some embodiments, each segment may include a generally peripheral segment of the transition piece 26. The cooling hole pattern 56 may be designed for the impingement sleeve 34 with respect to each of the plurality of segments of the transition piece 26. Thus, for example, a portion of the cooling hole pattern 56 may be designed for a segment of the transition piece 26. This resulting portion of the cooling hole pattern 56 may, in some embodiments, be input into the processor to further assist in the design of the cooling hole pattern 56. Another portion of the cooling hole pattern 56 may then be designed for another segment of the transition piece 26, and so on, until the cooling hole pattern 56 has been fully designed. Thus, in some exemplary embodiments, various of the above disclosed steps may be performed for segments of the transition piece 26, rather than the entire transition piece 26, to design the cooling hole pattern 56.

Further, after a cooling hole pattern 56 is determined for a transition piece 26 segment, that cooling hole pattern 56 may be utilized to determine the cooling hole pattern 56 for other transition piece 26 segments. Thus, the design of the cooling hole pattern 56 for each segment may be dependent on the pattern 56 for other segments. The pattern 56 of various segments may be revised as the patterns for other segments are designed, and the methods, or various portions thereof, herein may thus in general be iterative.

Thus, the impingement sleeves and methods of the present disclosure may provide optimal, targeted cooling of transition pieces 26. This cooling may provide one or more desired operational values for the transition piece 26, as desired. Further, the optimal, targeted cooling may reduce the pressure drop associated with cooling of the transition piece or provide more efficient or more optimal cooling for a given pressure drop, thus allowing for more efficient performance of the combustor 16 and system 10 in general.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An impingement sleeve for a combustor, comprising:

a body configured to at least partially surround a transition piece of the combustor; and a plurality of cooling holes defined in the body, the plurality of cooling holes having a cooling hole pattern configured to provide a desired operational value for the transition piece, at least one of the plurality of cooling holes having a chamfer extending at least partially between an inlet and an outlet of the at least one of the plurality of cooling holes, wherein at least a portion of the plurality of cooling holes arranged along a circumferential line about a longitudinal direction have size differences that are generally asymmetric about the longitudinal direction.

2. The impingement sleeve of claim 1, wherein the chamfer extends from the inlet towards the outlet.

3. The impingement sleeve of claim 1, wherein the chamfer extends between 5% and 80% of a thickness of the at least one of the plurality of cooling holes.

4. The impingement sleeve of claim 1, wherein the chamfer is at an angle between 10 degrees and 60 degrees.

5. The impingement sleeve of claim 1, further comprising an insert extending through the at least one of the plurality of cooling holes, the insert defining an insert cooling hole, the insert cooling hole having the chamfer.

6. The impingement sleeve of claim 5, wherein a thickness of the insert cooling hole is greater than a thickness of the cooling hole.

7. The impingement sleeve of claim 1, wherein each of the plurality of cooling holes has a chamfer.

8. An impingement sleeve for a combustor, comprising:

a body configured to at least partially surround a transition piece of the combustor; and a plurality of cooling holes defined in the body, the plurality of cooling holes having a cooling hole pattern configured to provide a desired operational value for the transition piece, wherein at least a portion of the plurality of cooling holes arranged along a circumferential line about a longitudinal direction have size differences that are generally asymmetric about the longitudinal direction; and an insert extending through one of the plurality of cooling holes, the insert defining an insert cooling hole.

9. The impingement sleeve of claim 8, wherein a thickness of the insert cooling hole is greater than a thickness of the cooling hole.

10. The impingement sleeve of claim 8, wherein the insert cooling hole has a chamfer extending at least partially between an inlet and an outlet of the insert cooling hole.

11. The impingement sleeve of claim 10, wherein the chamfer extends from the inlet towards the outlet.

12. The impingement sleeve of claim 10, wherein the chamfer extends through between 5% and 80% of a thickness of the at least one of the plurality of cooling holes.

13. The impingement sleeve of claim 10, wherein the chamfer is at an angle between 10 degrees and 60 degrees.

14. The impingement sleeve of claim 8, Wherein the insert is a plurality of inserts, each of the plurality of inserts extending through one of the plurality of cooling holes.

15. A method for designing an impingement sleeve, the method comprising:

determining a desired operational value for a transition piece;

inputting a combustor characteristic into a processor; and utilizing the combustor characteristic in the processor to determine a cooling hole pattern for the impingement sleeve, the cooling hole pattern comprising a plurality of cooling holes, at least a portion of the plurality of cooling holes arranged along a circumferential line about a longitudinal direction having size differences that are generally asymmetric about the longitudinal direction, the cooling hole pattern providing the desired operational value, wherein at least one of the plurality of cooling holes has a chamfer extending at least partially between an inlet and an outlet of the at least one of the plurality of cooling holes.

16. The method of claim 15, further comprising determining a heat flux of the transition piece.

17. The method of claim 15, wherein the desired operational value is at least one of a generally uniform low cycle fatigue value, an average low cycle fatigue value, a generally uniform temperature, an average temperature, a generally uniform strain, an average strain, a generally uniform cooing value, an average cooling value, a generally uniform thermal barrier coating temperature, or an average thermal barrier coating temperature.

18. The method of claim 15, wherein the combustor characteristic is at least one of hot gas temperature, working fluid temperature, transition piece stress, transition piece strain, transition piece material, impingement sleeve geometry, spacing between impingement sleeve and transition piece, number of cooling holes, number of cooling hole sizes, cooling hole sizes, total area of cooling holes, chamfer angle, chamfer thickness, cooling hole thickness, or relative cooling hole thickness.

19. The method of claim 15, further comprising determining a required cooling mode for the desired operational value.

20. The method of claim 15, further comprising partitioning the transition piece into a plurality of segments, Wherein a cooling hole pattern is determined for the impingement sleeve with respect to each of the plurality of segments.

* * * * *